US010568479B2

(12) United States Patent
Ni

(10) Patent No.: US 10,568,479 B2
(45) Date of Patent: Feb. 25, 2020

(54) HANDHELD DUST COLLECTOR HAVING SPIRAL TWO-STAGE TORNADO DUST-AIR SEPARATION STRUCTURE

(71) Applicant: KINGCLEAN ELECTRIC CO., LTD., Suzhou, Jiangsu (CN)

(72) Inventor: Zugen Ni, Jiangsu (CN)

(73) Assignee: KINGCLEAN ELECTRIC CO., LTD., Suzhou, Jiangsu (CN)

( * ) Notice: Subject to any disclaimer, the term of this patent is extended or adjusted under 35 U.S.C. 154(b) by 177 days.

(21) Appl. No.: 15/580,052

(22) PCT Filed: Nov. 19, 2015

(86) PCT No.: PCT/CN2015/094975
§ 371 (c)(1),
(2) Date: Dec. 6, 2017

(87) PCT Pub. No.: WO2016/197546
PCT Pub. Date: Dec. 15, 2016

(65) Prior Publication Data

US 2018/0296047 A1 Oct. 18, 2018

(30) Foreign Application Priority Data

Jun. 9, 2015 (CN) ..... 2015 1 0313317

(51) Int. Cl.
*A47L 5/24* (2006.01)
*A47L 5/28* (2006.01)
(Continued)

(52) U.S. Cl.
CPC ..... *A47L 9/1608* (2013.01); *A47L 5/24* (2013.01); *A47L 5/28* (2013.01); *A47L 9/12* (2013.01)

(58) Field of Classification Search
CPC ..... A47L 5/24; A47L 9/10; A47L 9/1641
See application file for complete search history.

(56) References Cited

U.S. PATENT DOCUMENTS 8,657,904 B2 * 2/2014 Smith

FOREIGN PATENT DOCUMENTS

CN 2801058 Y 8/2006
CN 101032384 A 9/2007
(Continued)

OTHER PUBLICATIONS

Extended European Search Report corresponding to Application No. 15894802.6-1018/3308687 PCT/CN2015094975; dated Jan. 17, 2019.

(Continued)

*Primary Examiner* — Michael D Jennings
(74) *Attorney, Agent, or Firm* — Cantor Colburn LLP

(57) ABSTRACT

A handheld dust collector, a spiral two-stage tornado dust-air separation structure and a primary dust barrel are disposed in the body of the handheld dust collector. The spiral two-stage tornado dust-air separation structure includes a first-stage cyclone barrel, a second-stage cyclone barrel, a cyclone cover, and a spiral dust-air separation apparatus disposed at the upper end of the second-stage cyclone barrel. The first-stage cyclone barrel and the cyclone cover perform first-stage dust-air separation on primary dust-air entering the spiral two-stage tornado dust-air separation structure, and second-stage dust-air after previous separation enters the second-stage cyclone barrel for second-stage dust-air separation. The dust collector is small in the number of components, simple in assembling procedure, and high in comprehensive performance of a complete machine. The spiral two-stage tornado dust-air separation structure is relatively small in size, and effectively reduces the space of a machine body and achieves a maximum dust storage volume.

9 Claims, 9 Drawing Sheets

(51) Int. Cl.
*A47L 9/16* (2006.01)
*A47L 9/12* (2006.01)

(56) References Cited

FOREIGN PATENT DOCUMENTS

| | | | |
|---|---|---|---|
| CN | 101411603 | A | 4/2009 |
| CN | 201431420 | Y | 3/2010 |
| CN | 202277306 | U | 6/2012 |
| CN | 202365717 | U | 8/2012 |
| CN | 202505268 | U | 10/2012 |
| CN | 202681838 | U | 1/2013 |
| CN | 203207967 | U | 9/2013 |
| CN | 203724037 | U | 7/2014 |
| CN | 204049527 | U | 12/2014 |
| CN | 104545695 | A | 4/2015 |
| CN | 104840152 | A | 8/2015 |
| CN | 204698456 | U | 10/2015 |
| EP | 1952743 | A2 | 8/2008 |
| KR | 20060118801 | A | 11/2006 |

OTHER PUBLICATIONS

International Search Report corresponding to Application No. PCT/CN2015/094975; dated Mar. 15, 2016.

* cited by examiner

HANDHELD DUST COLLECTOR HAVING SPIRAL TWO-STAGE TORNADO DUST-AIR SEPARATION STRUCTURE

CROSS REFERENCE TO RELATED APPLICATIONS

This is the U.S. national stage of application No. PCT/CN2015/094975, filed Nov. 19, 2015. Priority under 35 U.S.C. § 119(a) and 35 U.S.C. § 365(b) is claimed from Chinese Application No. 201510313317.5, filed Jun. 9, 2015, the disclosures of which are also incorporated herein by reference.

FIELD

The present application relates to the technical field of manufacturing of dust collectors, and in particular to a handheld dust collector having a spiral two-stage tornado dust-air separation structure.

BACKGROUND

Dust collectors, as articles for daily use, are widely used for the cleaning of indoor and outdoor. A dust collector is a cleaning appliance, in which air negative pressure is created in a sealed housing, by using vanes to rotate at a high speed with a motor, for sucking dust into a dust collecting device and discharging filtered air from a fan at an extremely high speed. The dust collectors are classified into dry type dust collectors and wet-dry type dust collectors according to their functions. The dry type dust collectors generally include dust-bag type dust collectors and machine-body type dust collectors. The dust collectors may be classified, according to their shapes, into horizontal dust collectors, vertical dust collectors and handheld dust collectors, and so on. The handheld dust collectors are convenient for cleaning articles such as a wall surface, a sofa, a windowsill, a desktop and an electrical appliance.

A dust-air separation mode of a dust collecting part of a conventional handheld dust collector is generally of a first-stage centrifugal separation mode or a dust-bag filtering mode, and both of the two filtering modes have a low filtering efficiency and are apt to cause blockage.

A conventional two-stage separation type machine body generally includes a two-stage dust-air separation structure. A first-stage structure is used for filtering large dirt in air, and a second-stage structure is used for separating and collecting small dirt such as dust particles. In the conventional two-stage dust-air separation structure, a second-stage cyclone is generally formed by cooperation between a cover plate for a filter of the machine body and a cyclone body having several cyclone openings. Such a structure requires a lot of parts and components, and further involves relatively more and complicated molds and assembly processes. Further, each link is difficult to be sealed, and it is apt to occur air leakage and dust leakage phenomena, which adversely affects comprehensive performance of the whole machine.

Chinese Patent CN 200520102558.7 discloses an integrated two-stage separation type machine body. The structure of the machine body is laid out in an axial direction, in which an inner tube and an outer tube of a dust removal device are axially arranged for separating the dust from the air. However, in such a design, there are a large number of components, and, a second-stage dust barrel, since being arranged in a first-stage dust barrel, occupies space of the first-stage dust barrel, which occupies a most dust-collecting volume of the machine body, and causes a limited dust storage space and affected dust suction effect. Moreover, an air return area of the second-stage dust barrel is small, resulting in a low air volume of the whole machine. Further, the structure of this two-stage dust-air separation type machine body requires the machine body to have a relatively large height and a relatively large volume, and the shape of the machine body is not applicable for a portable handheld dust collector, and the application scope thereof is limited. Also, since the handheld dust collector has great flexibility and has its orientation changed at any time at work, the dust in the conventional machine body is prone to back flow.

In view of the above issues, it is necessary to propose a novel handheld dust collector having a spiral two-stage tornado dust-air separation structure, which reduces the number of parts of the structure, simplifies assembly processes, improves the comprehensive performance of the whole machine and also effectively reduces the space of the machine body occupied by the two-stage dust-air separation structure, thereby achieving a maximum dust storage volume, improving dust collection efficiency and preventing the dust from back flowing effectively.

SUMMARY

In view of this, a handheld dust collector having a spiral two-stage tornado dust-air separation structure is provided according to the present application. A machine body of the handheld dust collector is provided therein with a spiral two-stage tornado dust-air separation structure which has a shape conforming to the handheld dust collector. The handheld dust collector has fewer components and is easy to assemble, and comprehensive performance of the whole machine is improved. Moreover, the space of the machine body occupied by the two-stage dust-air separation structure is reduced effectively, and a maximum dust storage volume is achieved, and thus dust collection efficiency is improved and dust backflow is prevented effectively.

In a handheld dust collected proposed according to an object of the present application, an accommodating space is provided in a machine body of the handheld dust collector. A spiral two-stage tornado dust-air separation structure is provided in the accommodating space, and a portion of the accommodating space at a different side of the spiral two-stage tornado dust-air separation structure forms a first-stage dust barrel. A portion of the accommodating space at a same side of the spiral two-stage tornado dust-air separation structure constrain a first-stage cyclone barrel of the spiral two-stage tornado dust-air separation structure.

Preferably, the spiral two-stage tornado dust-air separation structure includes a first-stage cyclone barrel, a second-stage cyclone barrel, a spiral dust-air separation device and a cyclone cover. The second-stage cyclone barrel is arranged in the first-stage cyclone barrel. The spiral dust-air separation device is arranged at an upper end of the second-stage cyclone barrel. The cyclone cover is arranged between the first-stage cyclone barrel and the second-stage cyclone barrel. A gap is provided between the second-stage cyclone barrel and an inner wall of the cyclone cover. The gap forms second-stage dust-air separation air duct which is used after a first-stage dust-air separation. The first-stage cyclone barrel and the cyclone cover perform the first-stage dust-air separation on primary dusty air which enters the two-stage dust-air separation device. Dusty air, after being subjected to the first-stage dust-air separation, enters the second-stage cyclone barrel to be subjected to a second-stage dust-air separation.

Preferably, the handheld dust collector includes a machine body air inlet. The first-stage cyclone barrel includes a first-stage dust shedding opening. The dust enters the first-stage cyclone barrel via the machine body air inlet to be subjected to the first-stage dust-air separation. The dust enters the first-stage dust barrel via the first-stage dust shedding opening under a centrifugal force.

Preferably, a second-stage dust collecting device is arranged below the second-stage cyclone barrel. The bottom of the second cyclone barrel forms the top of the second-stage dust collecting device. A sidewall of the second-stage cyclone barrel is provided with a second-stage dust shedding opening at a position close to the bottom of the second-stage cyclone barrel.

Preferably, the second-stage dust collecting device includes a dust intake body and a dust channel. The dust channel extends to the bottom of the machine body to abut against the first-stage dust barrel. The dust intake body and the dust channel are hermetically connected or integrally molded.

Preferably, at least a part of the dust intake body or at least a part of the dust channel or at least part of each of the dust intake body and the dust channel has a side formed by an inner side of the machine body, or the dust intake body or the dust channel or each of the dust intake body and the dust channel forms an independent second-stage dust collecting space.

Preferably, a central portion of the bottom of the second-stage cyclone barrel is designed to project downward, thereby preventing the dust from back flowing.

Preferably, a dust retaining barrel is provided in the second-stage cyclone barrel. A gap is provided between the dust retaining barrel and the second-stage cyclone barrel, and the gap forms a second-stage dust-air separation air duct. An inner side wall of the dust retaining barrel constrains the dusty air from rotating in the dust retaining barrel to generate a centrifugal force for resisting suction of negative pressure.

Preferably, after the dusty air is subjected to a first stage dust-air separation by the cyclone cover, at least part of the dusty air is guided to the spiral dust-air separation device through the second-stage dust-air separation air duct, and forms, at an inner wall of the second-stage cyclone barrel, airflow rotating towards the bottom of the second-stage cyclone barrel under guidance of the spiral dust-air separation device. Dust in the airflow, driven by a centrifugal force, rotates downward to the bottom of the second-stage cyclone barrel and is collected in the second-stage dust collecting space, and air in the rotating airflow is sucked out of an air outlet of the spiral two-stage tornado dust-air separation structure by the negative pressure, and thus the second-stage dust-air separation is realized.

Preferably, a filtering device is further provided at an upper end of an air outlet of the machine body. The filtering device may be a cotton filter. The dusty air having a small dust concentration is subjected to a final filtration by the cotton filter after passing through the air outlet of the machine body.

Preferably, the spiral dust-air separation device includes a spiral impeller for generating second-stage cyclone. The spiral impeller is provided with several downward-inclined vanes, and the vanes constrain the dusty air to swoop down obliquely.

Preferably, the spiral dust-air separation device further includes an inner ring arranged on an inner periphery of the spiral impeller. Multiple guidance tangent planes are provided on a side wall, corresponding to an air outlet of the spiral impeller, of the inner ring. The guidance tangent planes constrain the dusty air to flow to an outer periphery of the spiral impeller, and thus the dusty air begins to be in rotation.

Preferably, an overall air-intake area of the spiral impeller is less than an air-outgoing area of the spiral two-stage tornado dust-air separation structure, making the centrifugal force created by rotation of the dusty air sufficient to resist suction of the negative pressure.

Compared with the conventional technology, the handheld dust collector disclosed according to the present application has the following advantages.

Since the handheld dust collector employs the spiral two-stage tornado dust-air separation structure, filtering efficiency is improved, parts and components of the structure are reduced, assembly process is simplified and comprehensive performance of the whole machine is improved with respect to employing a conventional dust collecting mode.

The dust-air separation structure has a small volume, which reduces the space of the machine body occupied by the dust-air separation structure, achieves a maximum dust storage capacity and improves dust collecting efficiency.

The spiral two-stage tornado dust-air separation structure and the dust barrel have shapes designed to conform to the shape of the handheld dust collector, and are therefore applicable for the handheld dust collector.

The central part of the bottom of the second-stage cyclone barrel is designed to project downward, and thus the dust is not apt to back flow.

The second-stage dust collecting device extends directly to the bottom of the machine body, and a part of the second-stage dust collecting device has a side formed by an inner side of the machine body, thereby saving materials and facilitating dumping dust.

Further, a filtering device is provided at the upper end of the air outlet of the machine body. The filtering device prevents the dust from being dumped out of the air outlet, and thus the final filtration is realized.

BRIEF DESCRIPTION OF THE DRAWINGS

For more clearly illustrating embodiments of the present application or the technical solutions in the conventional technology, drawings referred to describe the embodiments or the conventional technology will be briefly described hereinafter. Apparently, the drawings in the following description are only examples of the present application, and for the person skilled in the art, other drawings may be obtained based on the drawings without any creative efforts.

EXPLANATION OF REFERENCE NUMERALS AND COMPONENTS REFERRED TO IN THE DRAWINGS

100. machine body,
110. first-stage dust barrel,
111. first-stage dust shedding opening,
120. air inlet of machine body,
130. air outlet of machine body,
140. partition plate,
150. opening,
210. first-stage cyclone barrel,
211. cyclone cover,
212. second-stage cyclone barrel,
213. first-stage air-intake duct,
214. second-stage dust collecting device,
215. dust retaining barrel,
216. second-stage dust-air separation air duct,
217. second-stage dust shedding opening,
220. spiral dust-air separation device,
221. spiral impeller,
222. inner ring,
223. guidance tangent plane,
224. wind shielding plate,
230. filtering device,
231. spiral groove,
232. dust intake body,
233. dust channel.

DETAILED DESCRIPTION OF EMBODIMENTS

A conventional two-stage dust-air separation structure requires a lot of parts and components, and further involves relatively more and complicated molds and assembly processes, and each link is difficult to be sealed, thus air leakage and dust leakage phenomena are apt to occur, which adversely affects comprehensive performance of a whole machine. In addition, the conventional two-stage dust-air separation type machine body structure is axially laid out, thus its filter structure occupies a large portion of the space of a machine body and occupies a most dust collecting volume of the machine body, and a dust storage space is limited. Moreover, this two-stage dust-air separation machine body structure requires the machine body to have a relatively large height and a relatively large volume, thus the shape of the machine body structure is not applicable for a portable handheld dust collector, and the application scope thereof is limited.

In view of the defects in the conventional technology, a handheld dust collector having a spiral two-stage tornado dust-air separation structure is provided according to the present application, which reduces the number of the parts of the structure, simplifies the assembly process, improves the comprehensive performance of the whole machine and also effectively reduces space occupied by a two-stage dust-air separation structure, thereby achieving a maximum dust storage volume, improving dust collection efficiency. In particular, shapes of the spiral two-stage tornado dust-air separation structure and a dust barrel are designed to conform to the shape of the handheld dust collector, so as to be applicable for the handheld dust collector.

Technical solutions of the present application are described clearly and completely with reference to embodiments hereinafter. Apparently, the described embodiments are only a few rather than all of the embodiments of the present application. Other embodiments obtained by the person skilled in the art without any creative efforts based on the embodiments of the present application fall into the scope of the present application.

Figure 1:
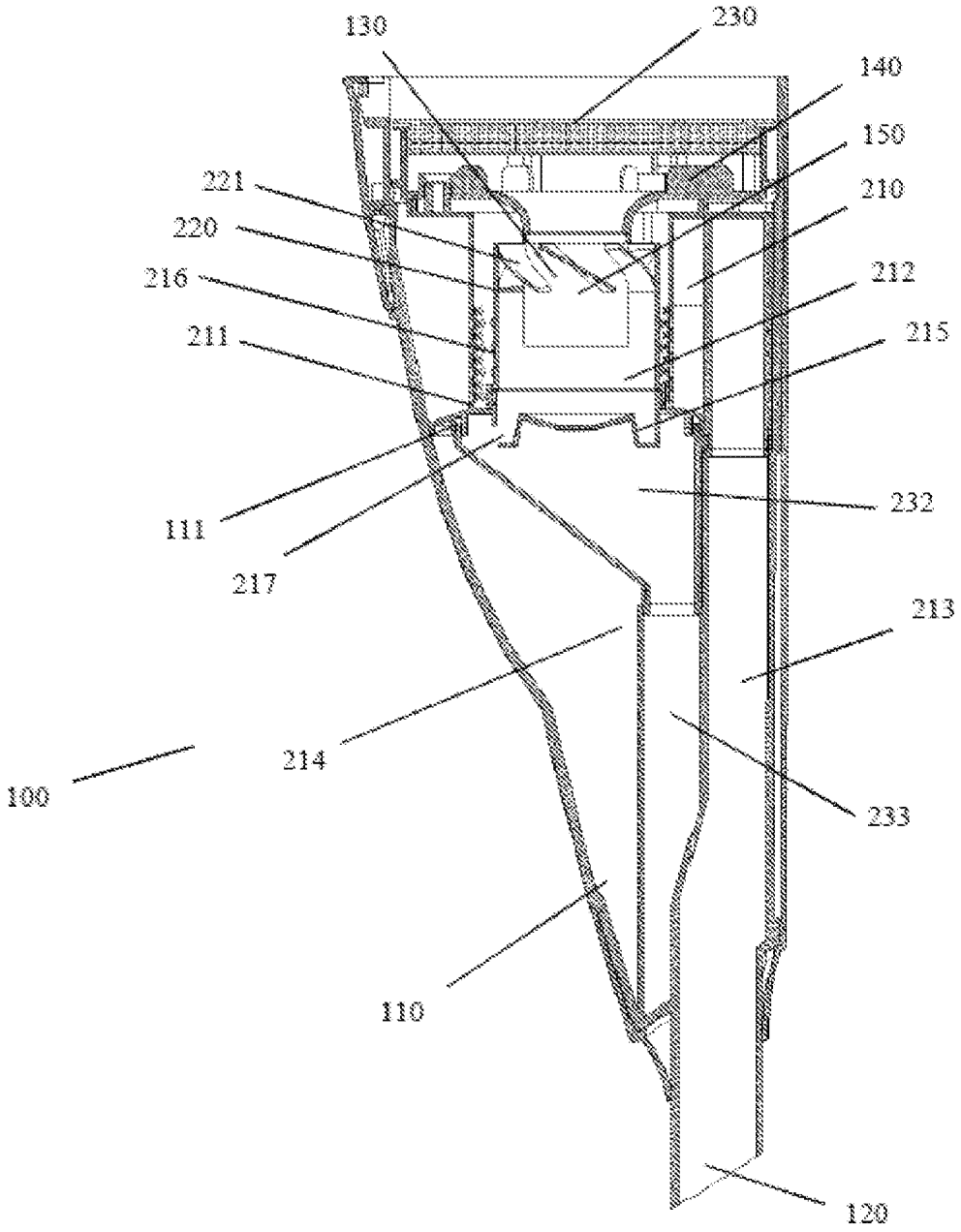
FIG. 1 is a sectional view showing an internal structure of a machine body.
Figure 2:
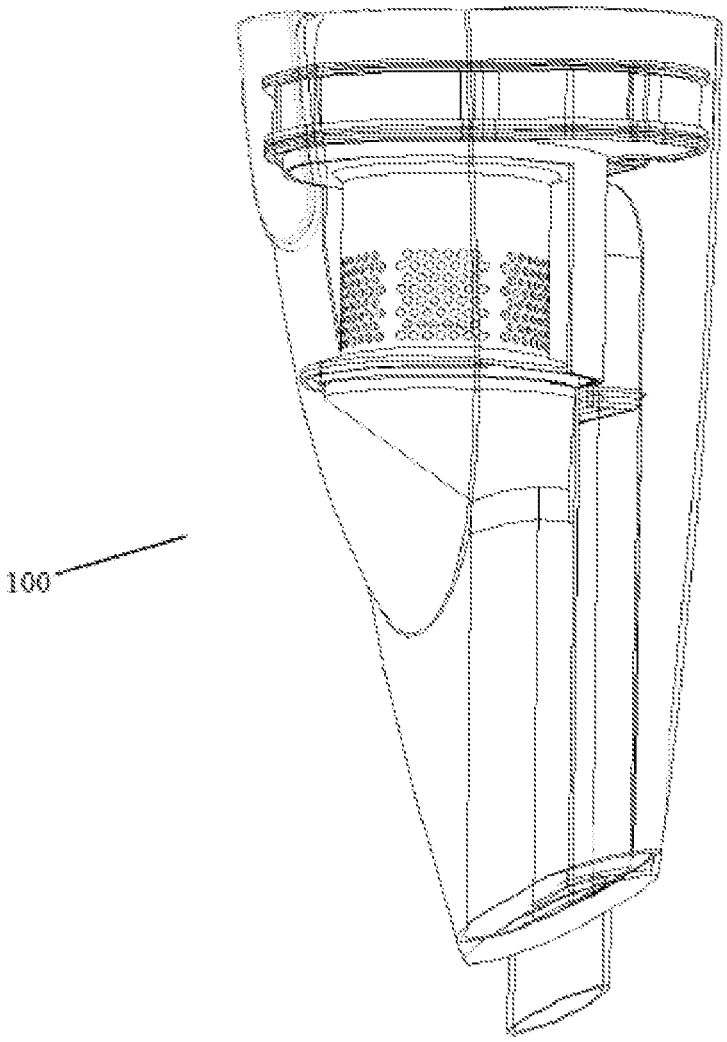
FIG. 2 is a view showing an overall appearance of the machine body.
Figure 3:
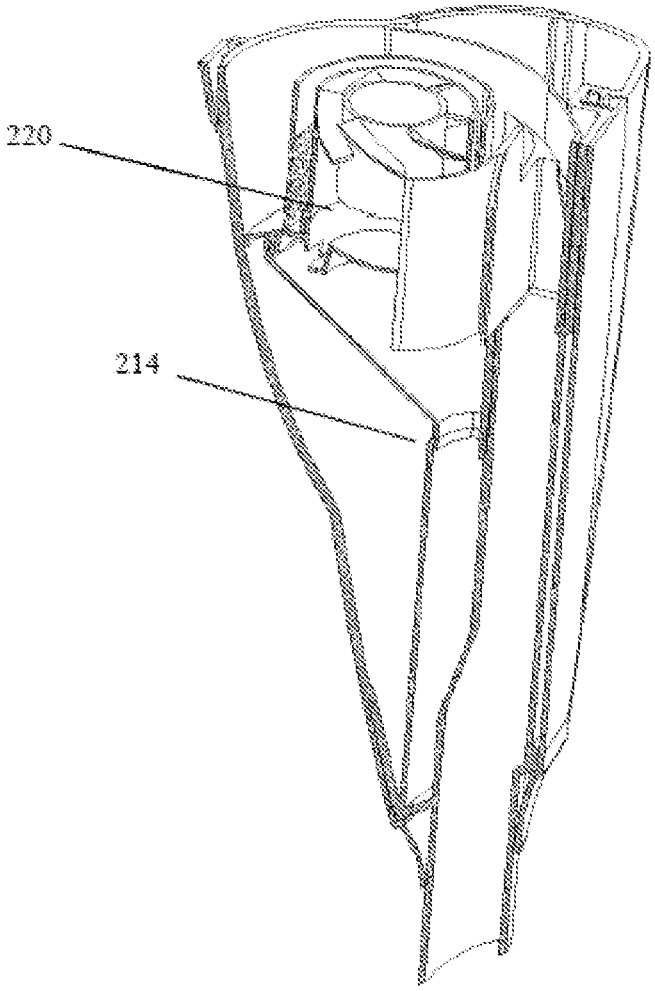
FIG. 3 is a view showing the internal structure of the machine body.
Figure 4:
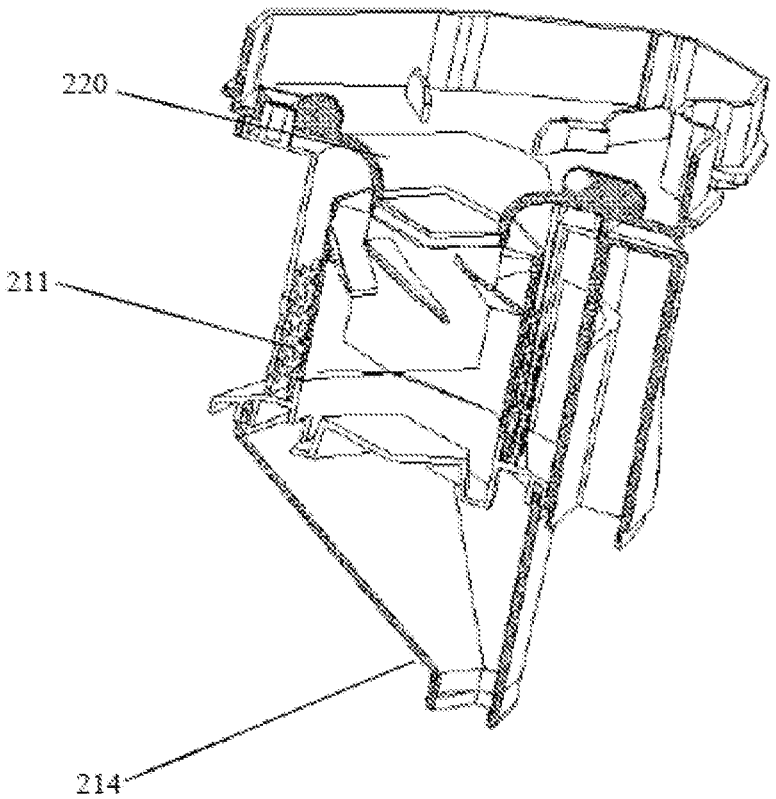
FIG. 4 is a schematic view of a second-stage cyclone barrel and a second-stage dust collecting device.
Figure 5:
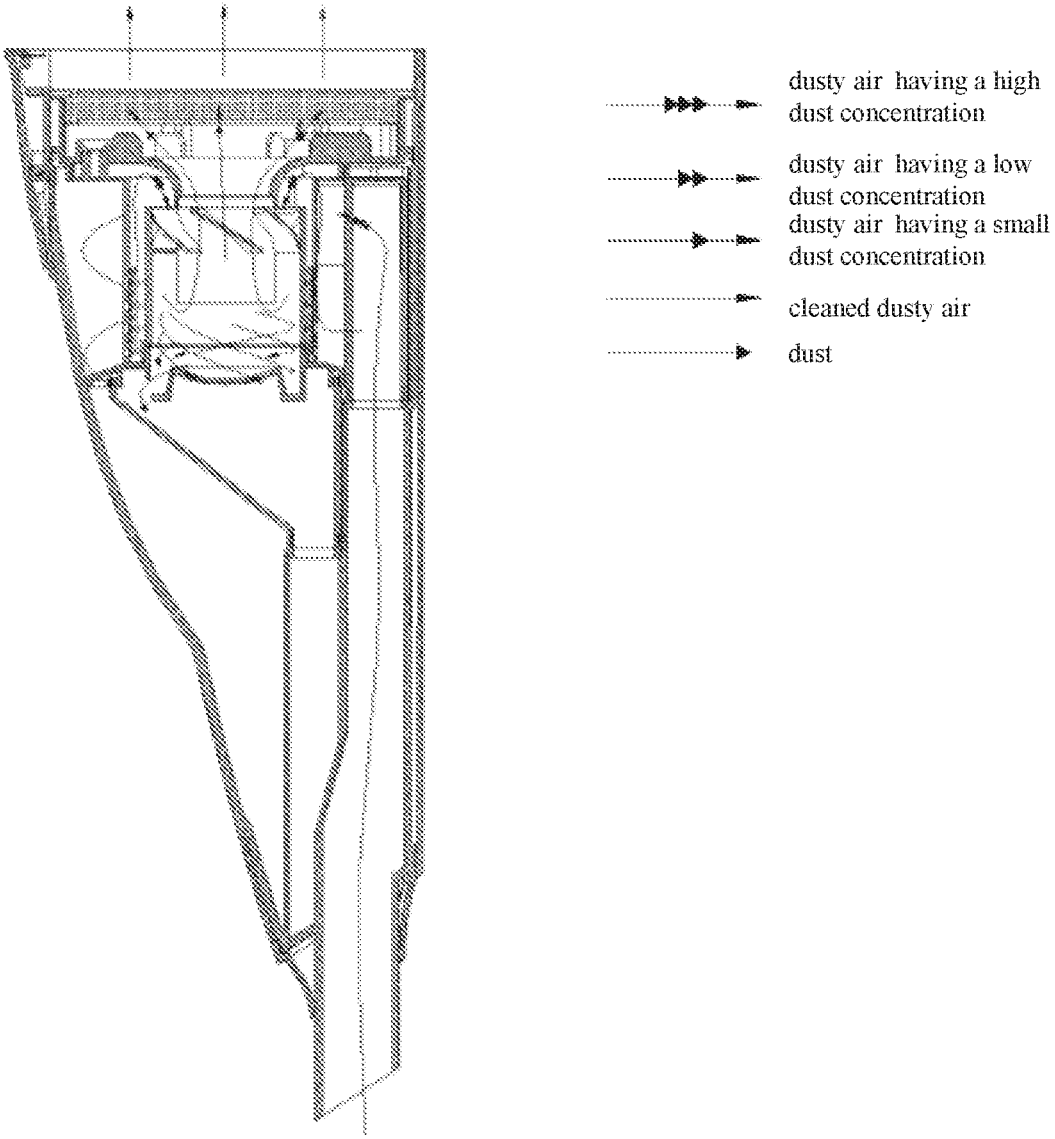
FIG. 5 is a view showing flowing directions of airflow in the machine body.
Figure 6:
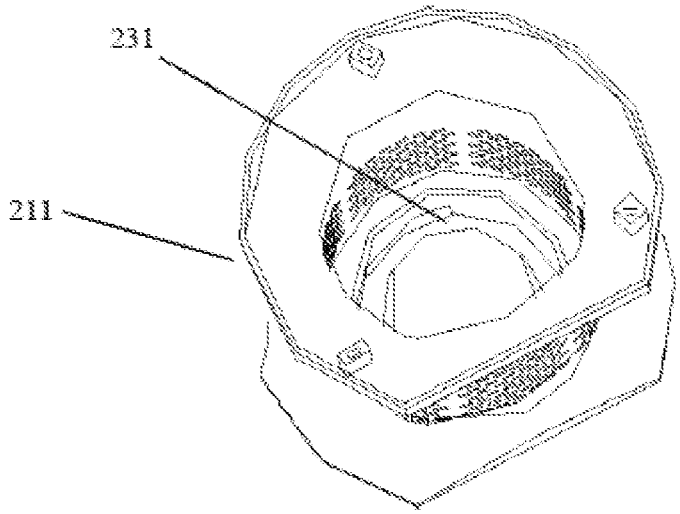
FIG. 6 is a perspective view showing the appearance and interior of a cyclone cover.
Figure 6:
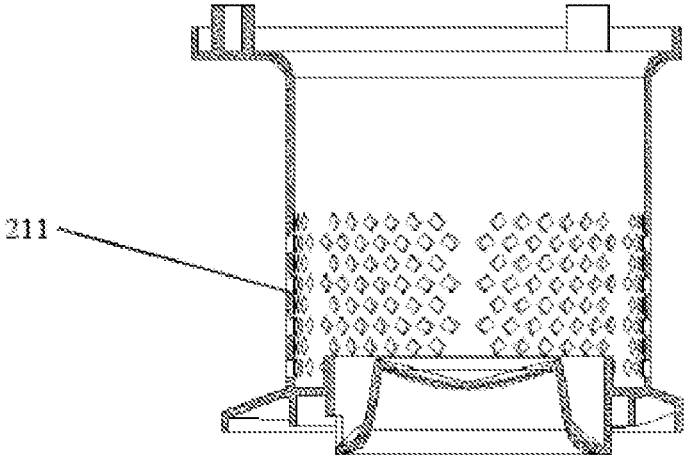
Figure 7:
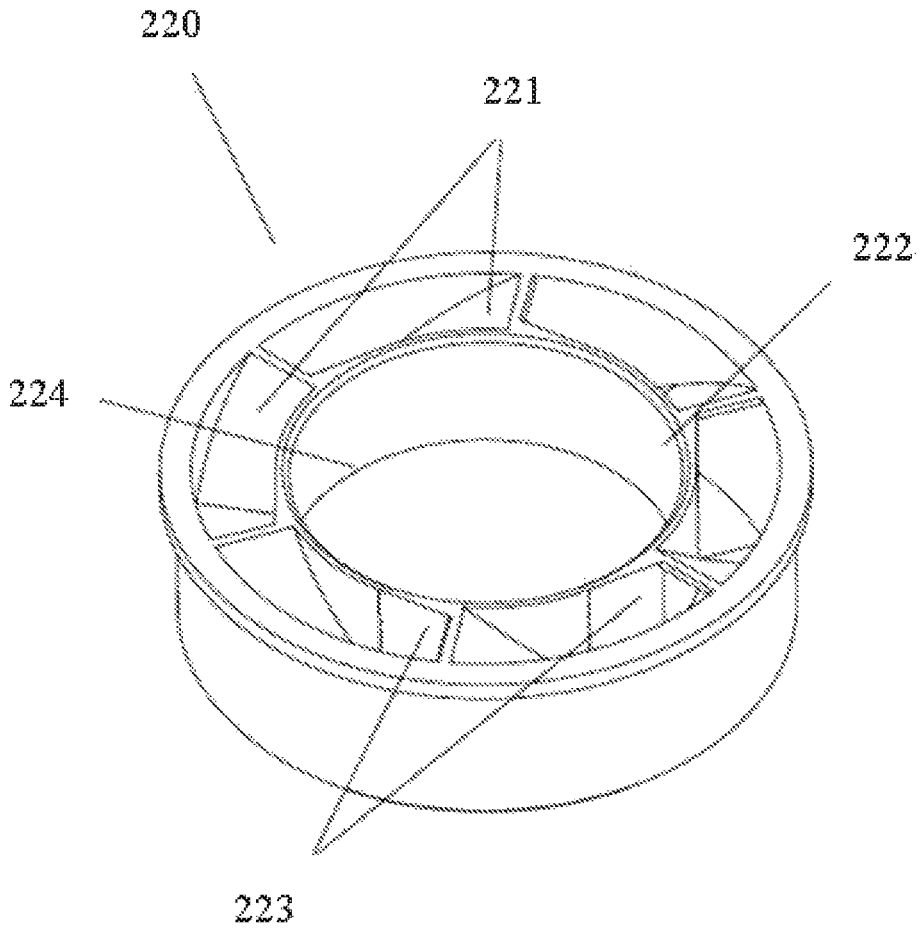
FIG. 7 is a schematic view showing a structure of a spiral dust-air separation device.
Figure 8:
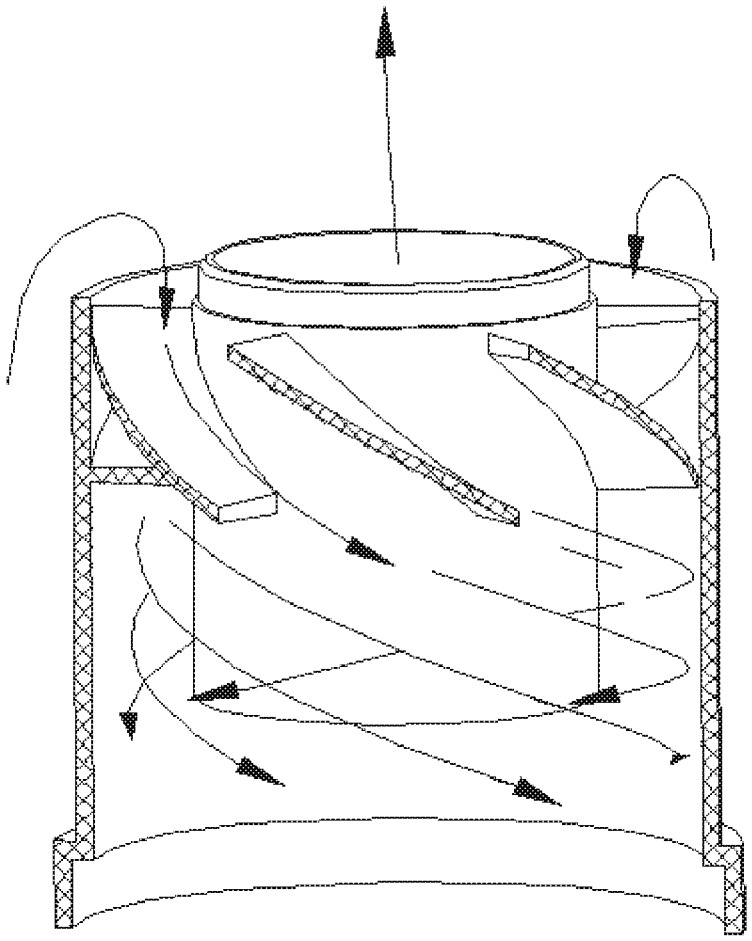
FIG. 8 is a schematic view showing flowing directions of airflow in the spiral dust-air separation device.
Figure 9:
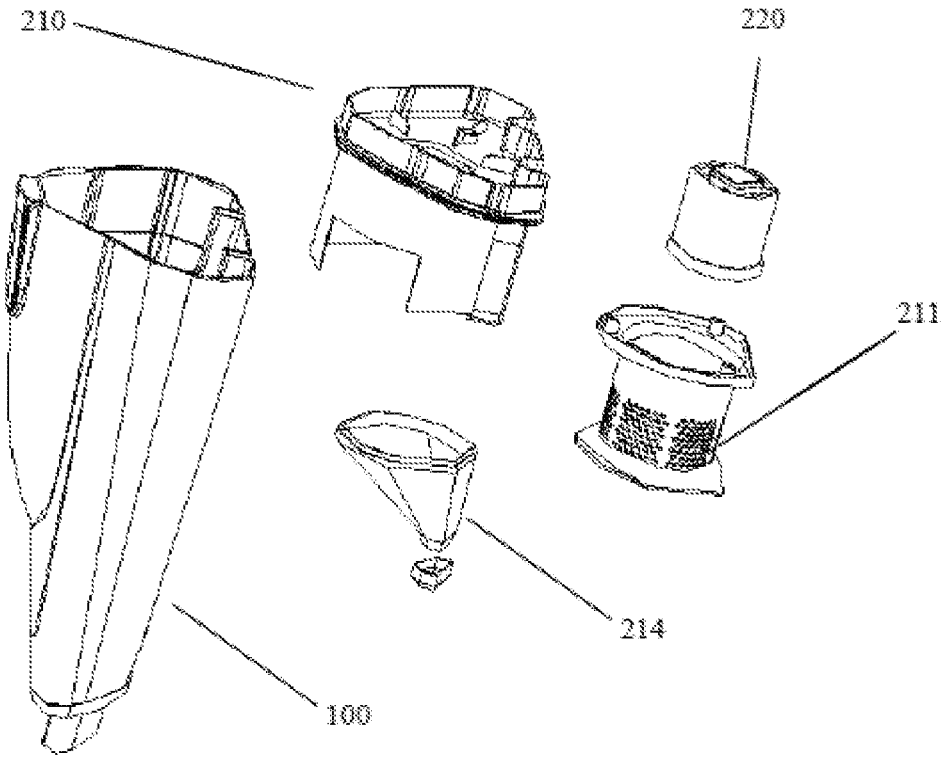
FIG. 9 is an exploded view of the machine body.

Referring to FIGS. 1 to 9, a handheld dust collector is provided. An accommodating space is provided in a machine body. A spiral two-stage tornado dust-air separation structure is provided in the accommodating space. A portion of the accommodating space at a different side of the spiral two-stage tornado dust-air separation structure forms a first-stage dust barrel 110, and a portion of the accommodating space at a same side of the spiral two-stage tornado dust-air separation structure constitutes a first-stage cyclone barrel 210 of the spiral two-stage tornado dust-air separation structure.

The spiral two-stage tornado dust-air separation structure includes the first-stage cyclone barrel 210, a second-stage cyclone barrel 212 and a cyclone cover 211. The second-stage cyclone barrel 212 is arranged in the first-stage cyclone barrel 210, and the cyclone cover 211 is arranged between the first-stage cyclone barrel and the second-stage cyclone barrel. A gap is provided between the second-stage cyclone barrel and an inner wall of the cyclone cover. The gap forms a second-stage dust-air separation air duct 216, which is used after a first-stage dust-air separation. The first-stage cyclone barrel includes a first-stage dust shedding opening 111. Dusty air enters the first-stage cyclone barrel via an air inlet. The first-stage cyclone barrel 210 and the cyclone cover 211 carry out a first-stage dust-air separation on primary dusty air which enters the first-stage cyclone barrel. Dust enters the first-stage dust barrel 110 via the first-stage dust shedding opening 111 under a centrifugal force. The dusty air with a low dust concentration, after being subjected to the first-stage separation, is sucked into the second-stage dust-air separation air duct 216 by a mesh screen of the cyclone cover, forming a second-stage cyclone under constraint of the second-stage cyclone barrel after passing through a spiral dust-air separation device.

A spiral groove 231 is provided at an inner side of an upper end of the cyclone cover, which allows airflow to rotate at the upper end of the cyclone cover and create a centrifugal force, and is convenient for the airflow to rotate downward into the spiral dust-air separation device.

A spiral dust-air separation device 220 is provided at an upper barrel opening of the second-stage cyclone barrel 212. After the dusty air is subjected to a first stage dust-air separation by the cyclone cover 211, at least a part of the dusty air is guided to the spiral dust-air separation device 220 through the second-stage dust-air separation air duct 216, and forms, at an inner wall of the second-stage cyclone barrel 212, airflow rotating towards the bottom of the second-stage cyclone barrel under guidance of the spiral dust-air separation device. A second-stage dust collecting device 214 is provided under the second-stage cyclone barrel 212. The bottom of the second-stage cyclone barrel forms the top of the second-stage dust collecting device. The second-stage cyclone barrel is hermetically connected to or integrally molded with the second-stage dust collecting device.

A sidewall of the second-stage cyclone barrel 212 is provided with a second-stage dust shedding opening 217 at a position close to the bottom of the second-stage cyclone barrel 212, and a central portion of the bottom of the second-stage cyclone barrel 212 is designed to project downward at a position close to the second-stage dust shedding opening 217. As a result, in the case that air flows, air pressure in an upper part of the second-stage cyclone barrel 212 is higher than air pressure in a lower part of the second-stage cyclone barrel 212 and accordingly the dust flows from top to bottom, thereby preventing the dust from flowing back in the case that a posture of the handheld dust collector is changed in use. Dust in secondary dusty air is driven by the centrifugal force to rotate downward to the bottom of the second-stage cyclone barrel, and enters the second-stage dust collecting device 214 via the second-stage dust shedding opening 217, and the air in rotating airflow is sucked by a negative pressure, thereby realizing the second-stage dust-air separation.

The spiral dust-air separation device 220 includes a spiral impeller 221 for generating second-stage cyclone. The spiral impeller 221 is provided with several downward-inclined vanes, and the vanes can constrain the dusty air to swoop down obliquely to form spiral airflow.

The spiral dust-air separation device 220 further includes an inner ring 222 arranged on an inner periphery of the spiral impeller 221. Several guidance tangent planes 223 are arranged on a side wall, corresponding to an air outlet of the spiral impeller 221, of the inner ring 222. The guidance tangent planes constrain the dusty air to flow to an outer periphery of the spiral impeller, and thus the dusty air begins to be in a rotating state. An outer ring is provided at an outer periphery of the spiral impeller. With the inner ring and the outer ring, the airflow is guided, and the structural strength and stability of the spiral impeller are improved. A wind shielding plate 224 extends downward from a wall of the inner ring of the spiral impeller.

A dust retaining barrel 215 is provided in the second-state cyclone barrel 212. A gap is provided between the dust retaining barrel and the second-stage cyclone barrel, and the gap forms the second-stage dust-air separation air duct 216. The dusty air rotates spirally in the second-stage dust-air separation air duct to generate a centrifugal force, so as to enable the dust to fall down along the inner wall of the second-stage cyclone barrel. An inner side wall of the dust retaining barrel can constrain the dusty air to rotate in the dust retaining barrel, so as to generate a centrifugal force for resisting suction of the negative pressure, thereby realizing effective separation of dust from air.

The second-stage dust collecting device includes a dust intake body 232 and a dust channel 233. The dust intake body 232 and the dust channel 233 are hermetically connected through a sealing ring. The dust channel 233 may take an inner side of the machine body as its side, and extend to a lower part of the machine body to abut against the first-stage dust barrel. In this case, when clearing the dust collector of dust, all the dust falls into the first-stage dust barrel and the dust channel. By drawing out the spiral two-stage tornado dust-air separation structure and the dust intake body, the dust intake body 232 may be separated from the dust channel 233, and the dust may be dumped.

A filtering device 230 is further provided at an upper end of an air outlet of the machine body. The filtering device may be a cotton filter. The dusty air having a small dust concentration is subjected to a final filtration by the cotton filter after passing through the air outlet of the machine body.

The second-stage cyclone barrel and the spiral dust-air separation device may each have an integrally formed structure. After being molded, the spiral dust-air separation device is mounted directly at a central position of the second-stage cyclone barrel to complete the assembly. The specific molding manner is not limited.

In addition, the spiral two-stage tornado dust-air separation structure may also be integrally molded. The specific molding and assembling manner is not limited.

In a handheld dust collector according to the present application, an accommodating space is provided in a machine body 100. A spiral two-stage tornado dust-air separation structure is provided in the accommodating space. A portion of the accommodating space at a different side of the spiral two-stage tornado dust-air separation structure forms a first-stage dust barrel 110, and a portion of the accommodating space at a same side of the spiral two-stage tornado dust-air separation structure forms a first-stage cyclone barrel 210 of the spiral two-stage tornado dust-air separation structure. The spiral two-stage tornado dust-air separation structure includes the first-stage cyclone barrel 210, a second-stage cyclone barrel 212 and a cyclone cover 211. The second-stage cyclone barrel 212 is arranged in the first-stage cyclone barrel 210, and the cyclone cover 211 is arranged between the first-stage cyclone barrel and the second-stage cyclone barrel. A lower part of the machine body is provided with an air inlet 120, and an air outlet 130 is arranged on an upper side of the machine body. The dusty air is guided by the air inlet to the cyclone cover of the two-stage dust-air separation structure, and after the dusty air is subjected to a first stage dust-air separation by the cyclone cover 211, at least a part of the dusty air enters a second-stage cyclone barrel 212 through the cyclone cover, to be subjected to a second stage dust-air separation.

An overall air-intake area of the spiral impeller 221 is less than an air-outgoing area of the machine body, enabling the dusty air to have a higher rotation speed to resist suction of negative pressure under same air volume.

A partition plate 140 is arranged in the machine body, and an opening 150 extends downward from a center of the partition plate. The air subjected to the second stage dust-air separation is sucked by the negative pressure. By providing the partition plate to shield an upper end of the cyclone cover, the dusty air after being filtered by the cyclone cover may be guided from an upper end of the second-stage dust-air separation air duct into the spiral dust-air separation device, which realizes guidance to ingoing air. A central part of the partition plate has a downward-inclined arc-shaped structure, which facilitates guiding the movement of the dusty air.

A handheld dust collector is provided according to the present application, which includes a spiral two-stage tornado dust-air separation structure and a first-stage dust barrel. The spiral two-stage tornado dust-air separation structure, simply including a first-stage cyclone barrel, a second-stage cyclone barrel, a cyclone cover and a spiral dust-air separation device, may just achieve filtration and separation of the dusty air, which reduces the number of parts and components of the spiral two-stage tornado dust-air separation structure effectively and simplifies the assembly process, and facilitate improvement of the comprehensive performance of the whole machine. Moreover, the spiral two-stage tornado dust-air separation structure has a small volume, which reduces space occupied by the two-stage separation structure effectively, realizes a maximum dust storage volume and improves the dust collection efficiency, and in particular makes the spiral two-stage tornado dust-air separation structure be applicable for the handheld dust collector. Further, the second-stage dust collecting device extends directly to the bottom of the machine body, and takes the inner side of the machine body as its side, which saves materials and facilitates dumping dust.

The description of the embodiments herein enables the person skilled in the art to implement or use the present application. Various modifications to the embodiments are apparent to the person skilled in the art, and the general principle defined herein can be implemented in other embodiments without departing from the spirit or scope of the present application. Therefore, the present application is not limited to the embodiments described herein, but should be in accordance with the broadest scope consistent with the principle and novel features disclosed herein.

The invention claimed is:

1. A handheld dust collector, wherein an accommodating space is provided in a machine body of the handheld dust collector, and a spiral two-stage tornado dust-air separation structure is provided in the accommodating space, a portion of the accommodating space at a different side of the spiral two-stage tornado dust-air separation structure forms a first-stage dust barrel, and a portion of the accommodating space at a same side of the spiral two-stage tornado dust-air separation structure forms a first-stage cyclone barrel of the spiral two-stage tornado dust-air separation structure, the spiral two-stage tornado dust-air separation structure comprises a first-stage cyclone barrel, a second-stage cyclone barrel arranged in the first-stage cyclone barrel, a spiral dust-air separation device arranged at an upper end of the second-stage cyclone barrel, and a cyclone cover arranged between the first-stage cyclone barrel and the second-stage cyclone barrel, and a gap is provided between the second-stage cyclone barrel and an inner wall of the cyclone cover, and the gap forms a second-stage dust-air separation air duct, which is used after first-stage dust-air separation, and the first-stage cyclone barrel and the cyclone cover perform the first-stage dust-air separation on primary dusty air which enters the spiral two-stage tornado dust-air separation structure, and dusty air, after being subjected to the first-stage dust-air separation, enters the second-stage cyclone barrel to be subjected to a second-stage dust-air separation.

2. The handheld dust collector according to claim 1, wherein the handheld dust collector comprises a machine body air inlet, and the first-stage cyclone barrel comprises a first-stage dust shedding opening, and dust enters the first-stage cyclone barrel via the machine body air inlet to be subjected to the first-stage dust-air separation, and the dust enters the first-stage dust barrel via the first-stage dust shedding opening under a centrifugal force.

3. The handheld dust collector according to claim 1, wherein a second-stage dust collecting device is provided under the second-stage cyclone barrel, and the bottom of the second cyclone barrel forms the top of the second-stage dust collecting device, and a sidewall of the second-stage cyclone barrel is provided with a second-stage dust shedding opening at a position close to the bottom of the second-stage cyclone barrel.

4. The handheld dust collector according to claim 3, wherein the second-stage dust collecting device comprises a dust intake body and a dust channel, and the dust channel extends to the bottom of the machine body to abut against the first-stage dust barrel, and the dust intake body is hermetically connected to the dust channel, and the dust channel has a side formed by an inner side of the machine body or the dust channel is formed independently from the inner side of the machine body.

5. The handheld dust collector according to claim 3, wherein a central portion of the bottom of the second-stage cyclone barrel projects downward.

6. The handheld dust collector according to claim 3, wherein after the dusty air is subjected to the first stage dust-air separation by the cyclone cover, at least a part of the dusty air is guided to the spiral dust-air separation device through the second-stage dust-air separation air duct, and forms, at an inner wall of the second-stage cyclone barrel, airflow rotating towards the bottom of the second-stage cyclone barrel under guidance of the spiral dust-air separation device, and the dust in the airflow, driven by a centrifugal force, rotates downward to the bottom of the second-stage cyclone barrel and is collected in a second-stage dust collecting space, and air in the rotating airflow is sucked out of an air outlet of the spiral two-stage tornado dust-air separation structure by the negative pressure, and the second-stage dust-air separation is realized.

7. The handheld dust collector according to claim 6, wherein a filtering device is further provided at an upper end of an air outlet of the machine body, and the filtering device is a cotton filter, and the dusty air having a small dust concentration is subjected to final filtration by the cotton filter after passing through the air outlet of the machine body.

8. The handheld dust collector according to claim 1, wherein the spiral dust-air separation device comprises a spiral impeller for generating second-stage cyclone, and the spiral impeller is provided with a plurality of downward-inclined vanes, and the vanes constrain the dusty air to swoop down obliquely.

9. The handheld dust collector according to claim 8, wherein the spiral dust-air separation device further comprises an inner ring arranged on an inner periphery of the spiral impeller, and a plurality of guidance tangent planes are provided on a side wall, corresponding to an air outlet of the spiral impeller, of the inner ring, and the guidance tangent planes constrain the dusty air to flow to an outer periphery of the spiral impeller, and the dusty air begins to be in a rotating state.

* * * * *